US010483696B2

(12) United States Patent
Zhao

(10) Patent No.: US 10,483,696 B2
(45) Date of Patent: Nov. 19, 2019

(54) ELECTRICAL CONNECTOR HAVING AN IMPROVED ANNULAR WALL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/006,487

(22) Filed: Jun. 12, 2018

(65) Prior Publication Data

US 2018/0358756 A1 Dec. 13, 2018

(30) Foreign Application Priority Data

Jun. 12, 2017 (CN) ..... 2017 2 0679051 U

(51) Int. Cl.

| | |
|---|---|
| ***H01R 13/658*** | (2011.01) |
| ***H01R 13/6585*** | (2011.01) |
| ***H01R 13/502*** | (2006.01) |
| ***H01R 13/52*** | (2006.01) |
| ***H01R 43/00*** | (2006.01) |
| ***H01R 43/24*** | (2006.01) |
| ***H01R 24/60*** | (2011.01) |
| ***H01R 13/03*** | (2006.01) |
| ***H01R 13/6581*** | (2011.01) |
| *H01R 107/00* | (2006.01) |
| *H01R 43/18* | (2006.01) |

(52) U.S. Cl.

CPC ..... *H01R 13/6585* (2013.01); *H01R 13/035* (2013.01); *H01R 13/502* (2013.01); *H01R 13/5202* (2013.01); *H01R 13/6581* (2013.01); *H01R 24/60* (2013.01); *H01R 43/005* (2013.01); *H01R 43/24* (2013.01); *H01R 43/18* (2013.01); *H01R 2107/00* (2013.01)

(58) Field of Classification Search

CPC ..... H01R 13/6585; H01R 13/035; H01R 13/502; H01R 24/60; H01R 43/005

USPC ..... 439/607

See application file for complete search history.

(56) References Cited

U.S. PATENT DOCUMENTS 6,619,986 B1 * 9/2003 Yeh ..... H01R 13/506 439/607.4

6,840,806 B2 * 1/2005 Kodama ..... H01R 13/6271 439/607.24

(Continued)

FOREIGN PATENT DOCUMENTS

CN 107293916 10/2017

*Primary Examiner* — Alexander Gilman

(74) *Attorney, Agent, or Firm* — Wei Te Chung; Ming Chieh Chang

(57) ABSTRACT

An electrical connector includes an insulative housing, plural conductive terminals affixed to the insulative housing, and a shielding shell enclosing the insulative housing for forming a receiving room. The insulative housing includes a base portion and a tongue portion extending forwardly from the base portion. Each conductive terminal has a contacting portion disposed in the tongue portion. The shielding shell has a first wall, a second wall opposite to the first wall, and a pair of lateral walls connecting the first wall and the second wall. The thickness of the first wall is smaller than that of the lateral walls.

18 Claims, 10 Drawing Sheets

(56) References Cited

U.S. PATENT DOCUMENTS

| | | | | |
|---|---|---|---|---|
| 7,938,683 | B2 * | 5/2011 | Nagata | H01R 12/724 439/607.13 |
| 8,662,928 | B1 * | 3/2014 | Xie | H01R 13/6594 439/607.35 |
| 8,696,384 | B2 * | 4/2014 | Yokoyama | H01R 12/77 439/607.36 |
| 8,854,835 | B2 * | 10/2014 | Feldstein | H01R 12/724 174/351 |
| 8,956,185 | B2 * | 2/2015 | Lan | H01R 13/506 439/607.13 |
| 8,961,231 | B2 * | 2/2015 | Wright | H05K 3/368 439/350 |
| 9,011,178 | B2 * | 4/2015 | Hori | H01R 13/6581 29/842 |
| 9,391,391 | B2 * | 7/2016 | Chien | H01R 13/5202 |
| 9,893,468 | B2 * | 2/2018 | Zhao | H01R 24/60 |
| 10,044,125 | B2 * | 8/2018 | Qiu | H01R 12/7088 |
| 10,096,947 | B2 * | 10/2018 | Cheng | H01R 13/6581 |
| 10,135,196 | B2 * | 11/2018 | Wen | H01R 24/60 |
| 10,164,791 | B2 * | 12/2018 | Wang | H04L 12/40013 |
| 2016/0141806 | A1 * | 5/2016 | Guo | H01R 13/504 439/607.01 |
| 2017/0346238 | A1 * | 11/2017 | Ju | H01R 13/6585 |

* cited by examiner

ELECTRICAL CONNECTOR HAVING AN IMPROVED ANNULAR WALL

BACKGROUND OF THE DISCLOSURE

1. Field of the Disclosure

The present disclosure relates to an electrical connector, and more particularly to an electrical connector for lowering the height.

2. Description of Related Arts

As the mobile phone becomes thinner and thinner, and the height of the product becomes more and more critical, the thickness of the iron shell of the Type C connector is generally 0.2 mm to 0.3 mm. With the development of metal integrated/injection molding technology, the thickness of the iron shell can now be 0.15 mm. With further development of technology, the thickness of the iron shell can be thinner.

An improved electrical connector is desired.

SUMMARY OF THE DISCLOSURE

Accordingly, an object of the present disclosure is to provide an electrical connector of a low profile.

To achieve the above object, an electrical connector includes an insulative housing, a plurality of conductive terminals affixed to the insulative housing, and a shielding shell enclosing the insulative housing for forming a receiving room. The insulative housing includes a base portion and a tongue portion extending forwardly from the base portion. Each conductive terminal has a contacting portion disposed in the tongue portion. The shielding shell has a first wall, a second wall opposite to the first wall, and a pair of lateral walls connecting the first wall and the second wall. The thickness of the first wall is smaller than that of the lateral walls. The invention can reduce the height by reducing the thickness of the first wall and/or the second wall of the shielding shell. The thickness of the sidewall is greater than the thickness of the first wall or the second wall, thereby ensuring the strength of the electrical connector while meeting the requirement of product miniaturization.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
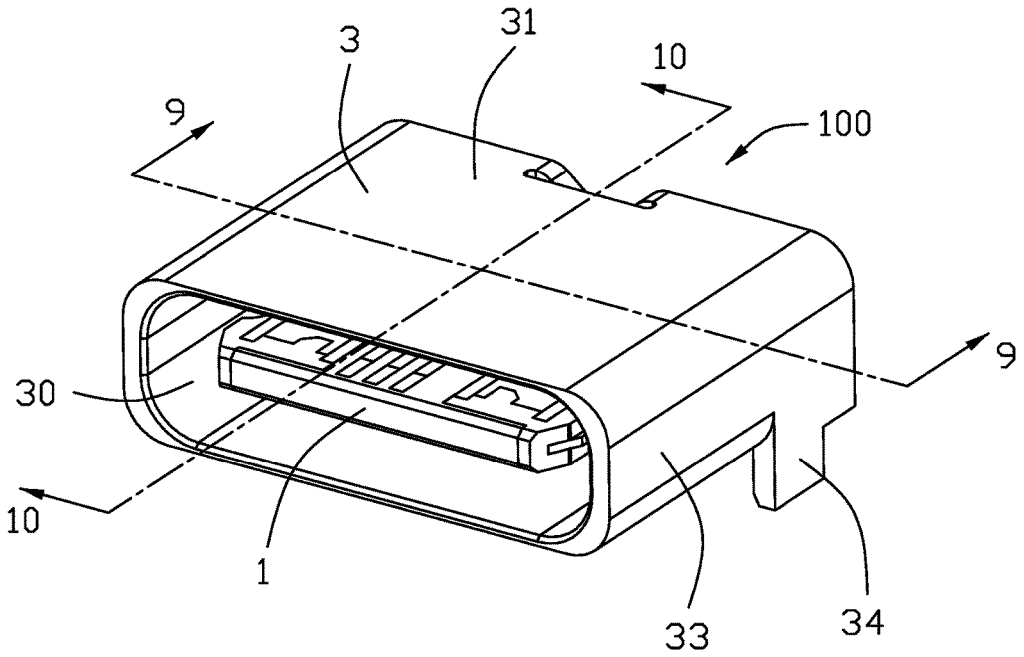
FIG. 1 is a perspective, assembled view of an electrical connector.
Figure 2:
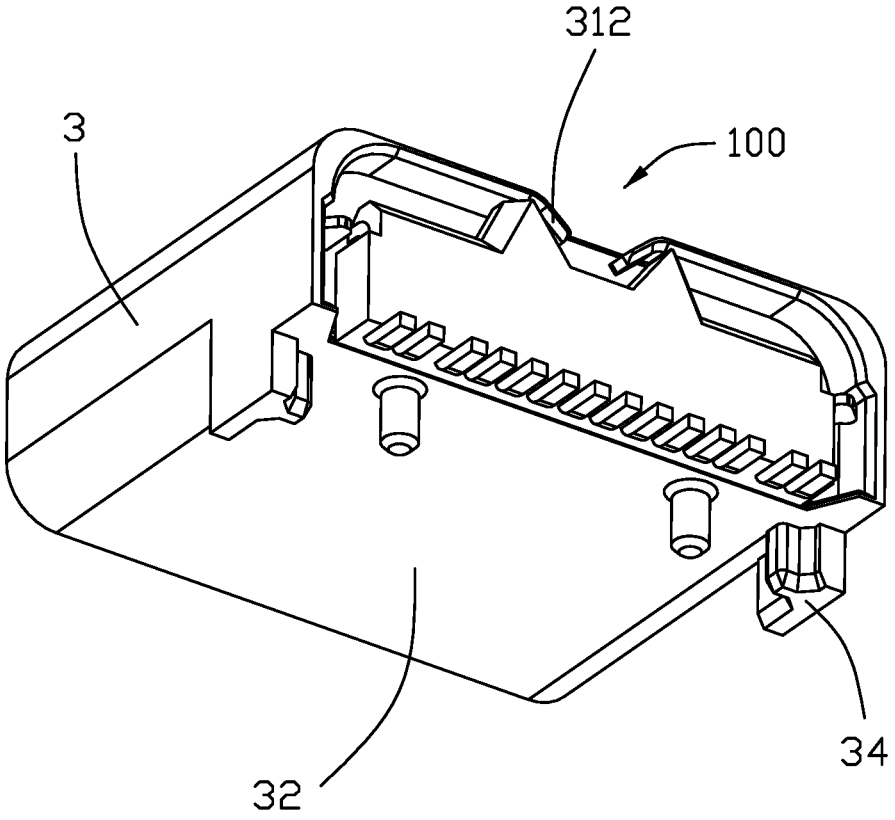
FIG. 2 is another perspective, assembled view of the electrical connector taken from FIG. 1.
Figure 3:
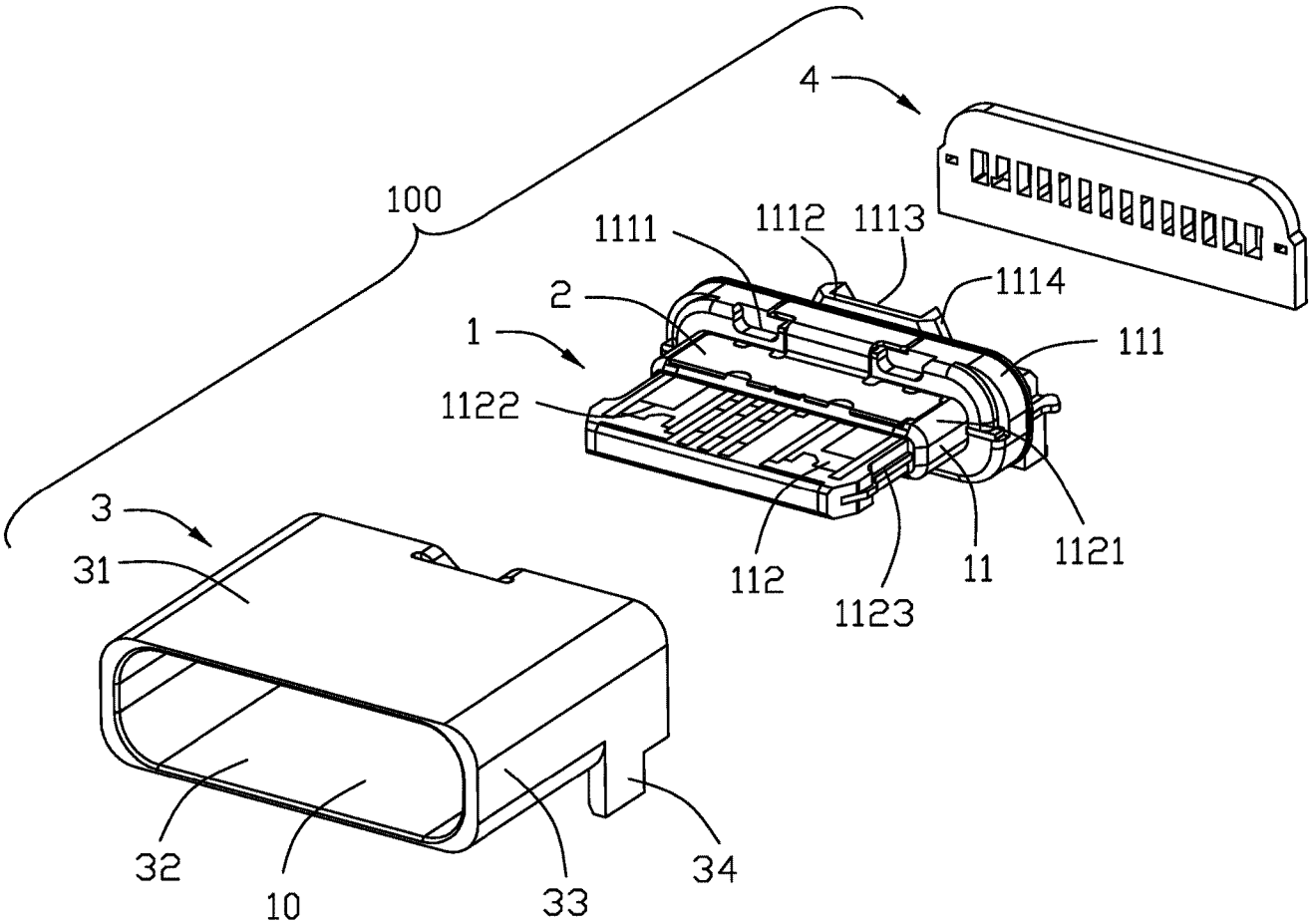
FIG. 3 is a partial exploded view of the electrical connector.
Figure 4:
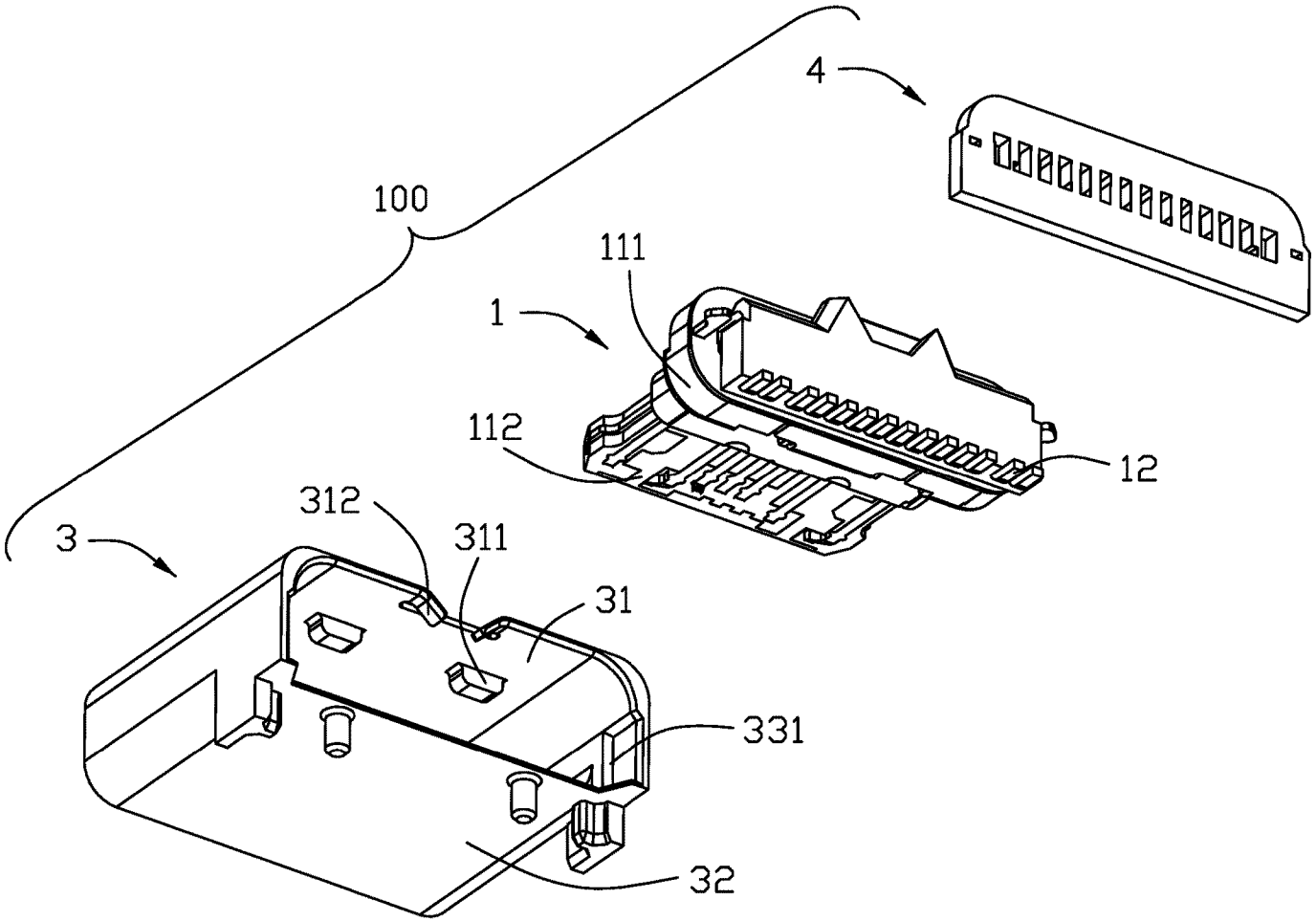
FIG. 4 is another partial exploded view of the electrical connector taken from FIG. 3.

Reference will now be made in detail to the embodiments of the present disclosure. The embodiment will be shown in FIGS. 1 to 10. The insert direction of the electrical connector 100 is a front-to-rear direction.

Referring to FIGS. 1 to 10, the electrical connector 100 includes a contact module 1, a pair of ground plates 2 affixed to the contact module 1, a metallic shielding shell 3 enclosing the contact module 1 for forming a receiving room 10 along the front-to-back direction, and a sealer 4 sealing a rear end of the electrical connector 100.

Referring to FIGS. 3 to 8, the contact module 1 includes an insulative housing 11, a number of conductive terminals or contacts 12 affixed to the insulative housing 11 via insert molding, and a shielding plate 13 affixed to the insulative housing 11. Referring to FIGS. 1 to 8, the insulative housing 11 includes a base portion 111 affixed to the shielding shell 3, a tongue portion 112 extending forwardly from the base portion 111 and forming a mating room 30 with the shielding shell 3 and an insulator 113. The base portion 111 includes a pair of resisting recesses 1111 located at a front end, a mounting portion 1112 located at a rear end, and a fixing slot 1115 extending laterally to the resisting recesses 1111 and communicating with the resisting recesses 111 with its front end. The mounting portion 1112 includes a fixing groove 1113 with an opening extending upwardly and a pair of resisting tubers 1114 located in symmetry of the fixing groove 1113. The tongue portion 112 includes a stepped portion 1121 abutting with the base portion 111, a flat portion 1122 extending forwardly from the stepped portion 1121 and a pair of mating grooves 1123 mated with a corresponding electrical connector. The thickness of the stepped portion 1121 is larger than that of the flat portion 1122.

Figure 5:
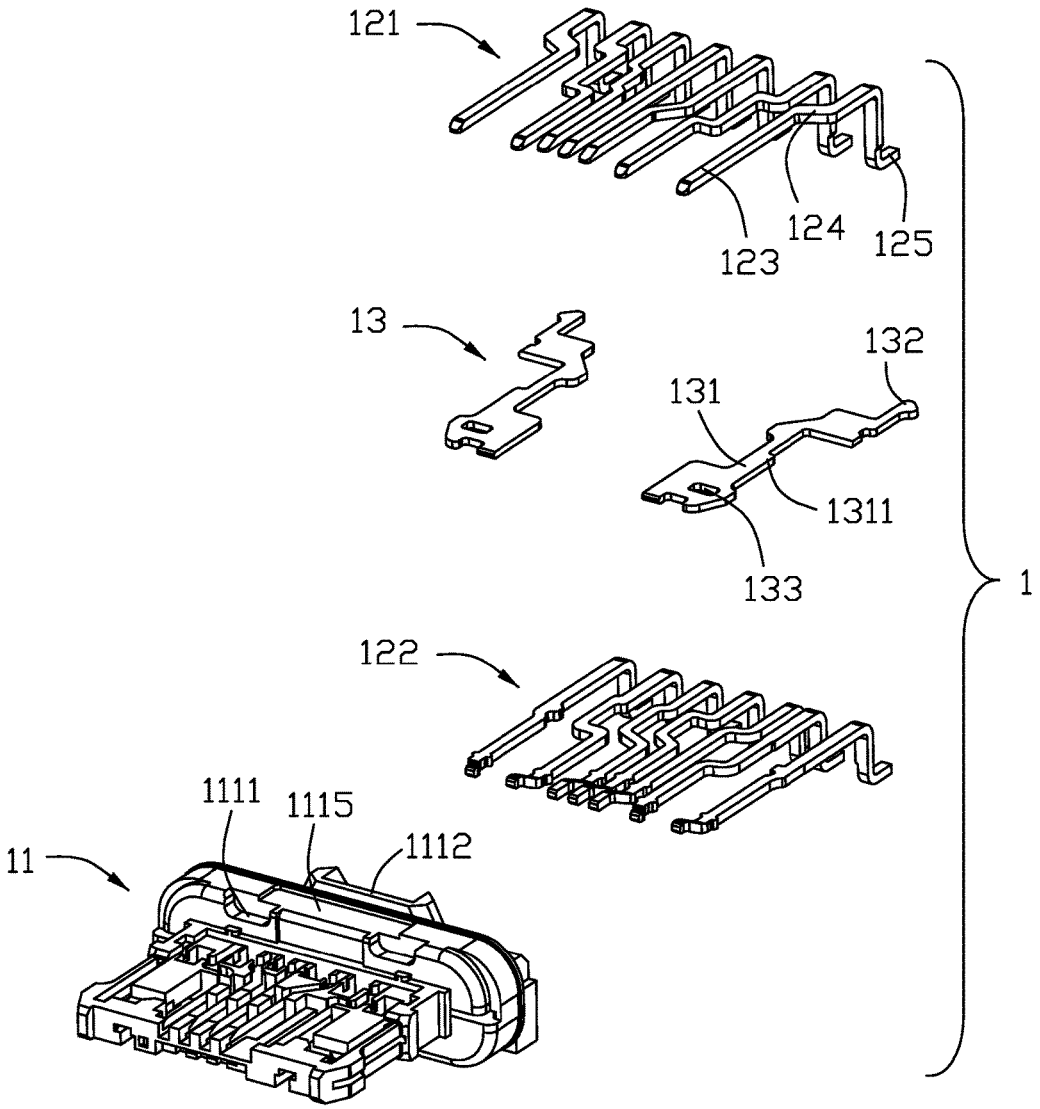
FIG. 5 is an exploded view of a contact module of the electrical connector.
Figure 6:
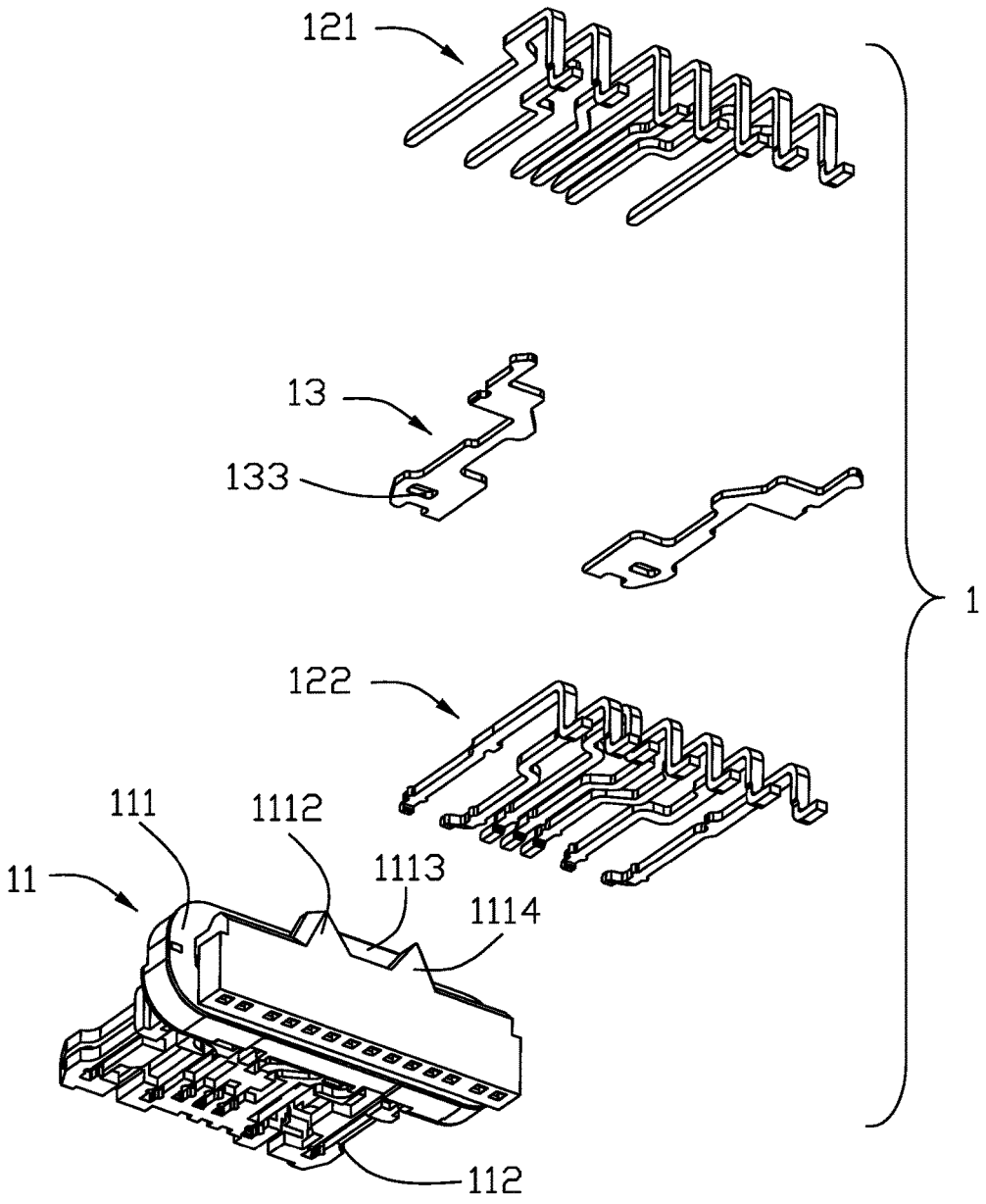
FIG. 6 is another exploded view of the contact module of the electrical connector taken from FIG. 5.
Figure 7:
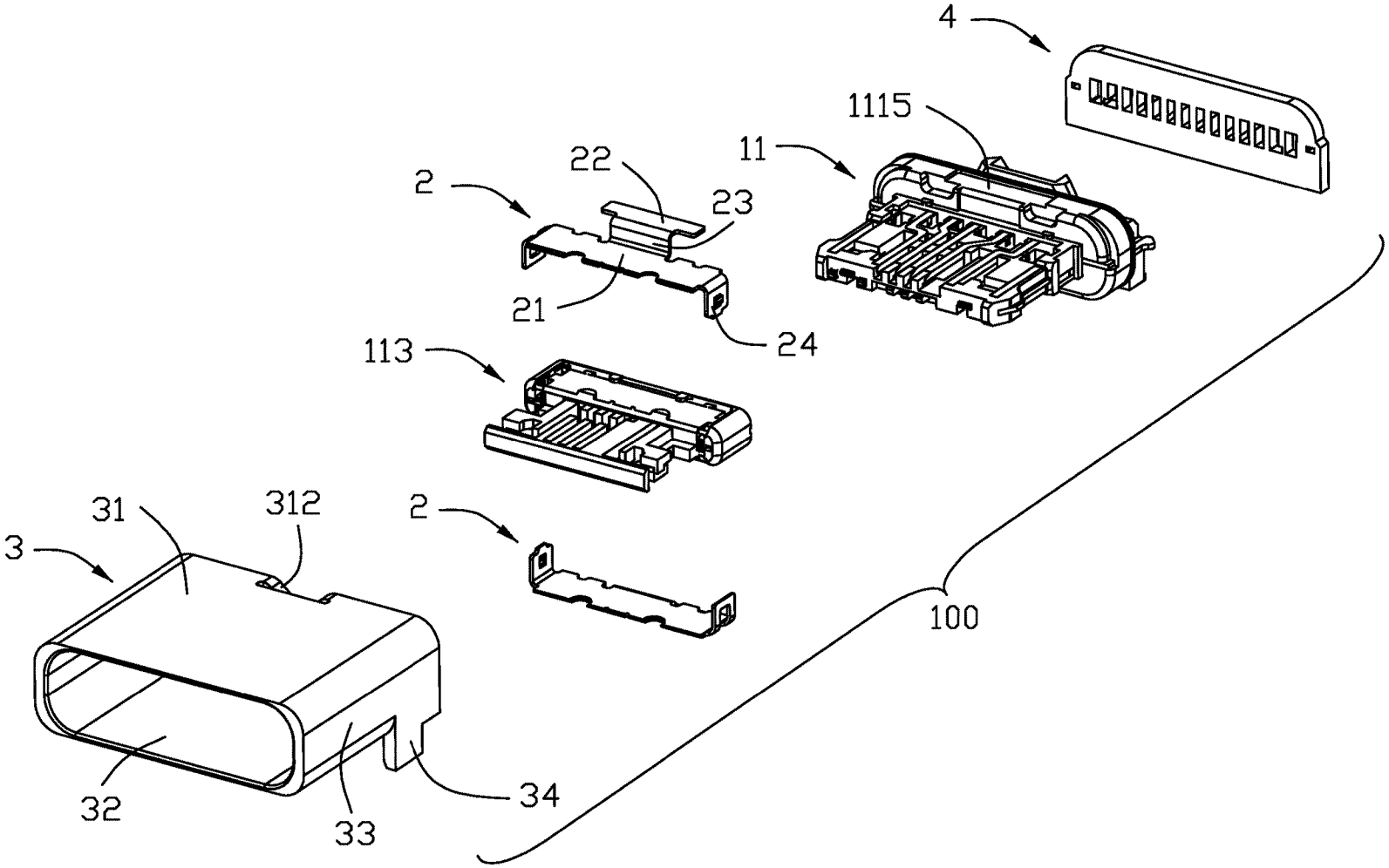
FIG. 7 is an exploded view of the electrical connector.
Figure 8:
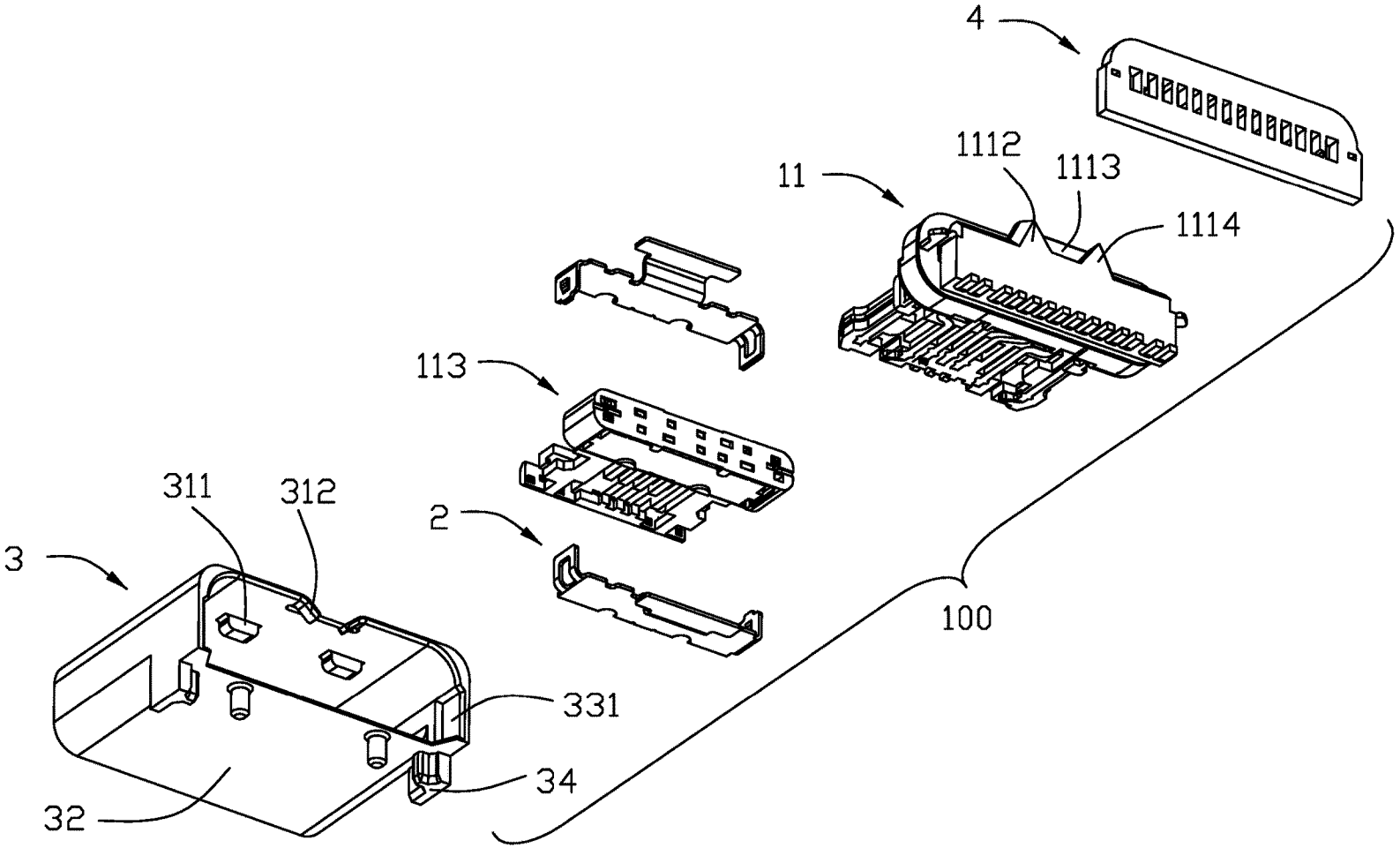
FIG. 8 is another view of the electrical connector taken from FIG. 7.
Figure 9:
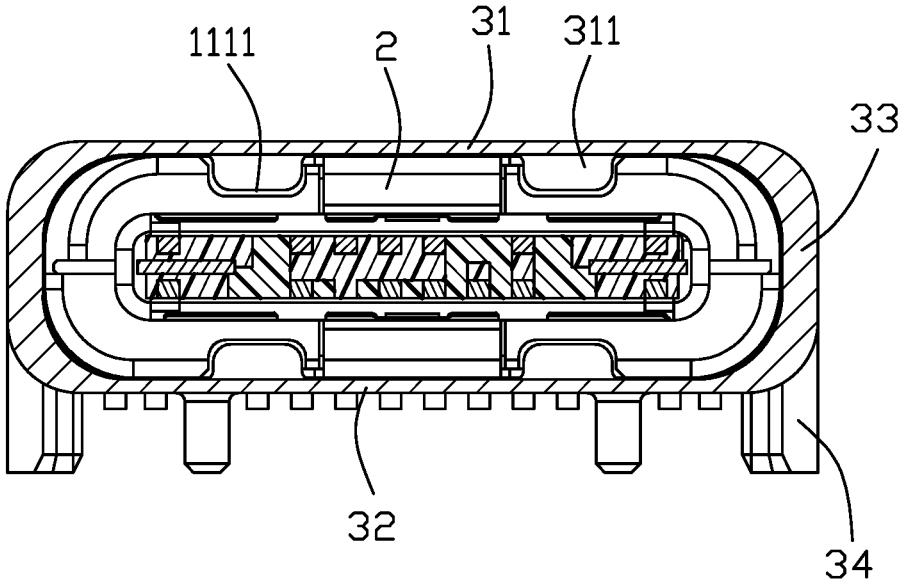
FIG. 9 is a cross-sectional view of the electrical connector taken along line 9-9 in FIG. 1.
Figure 10:
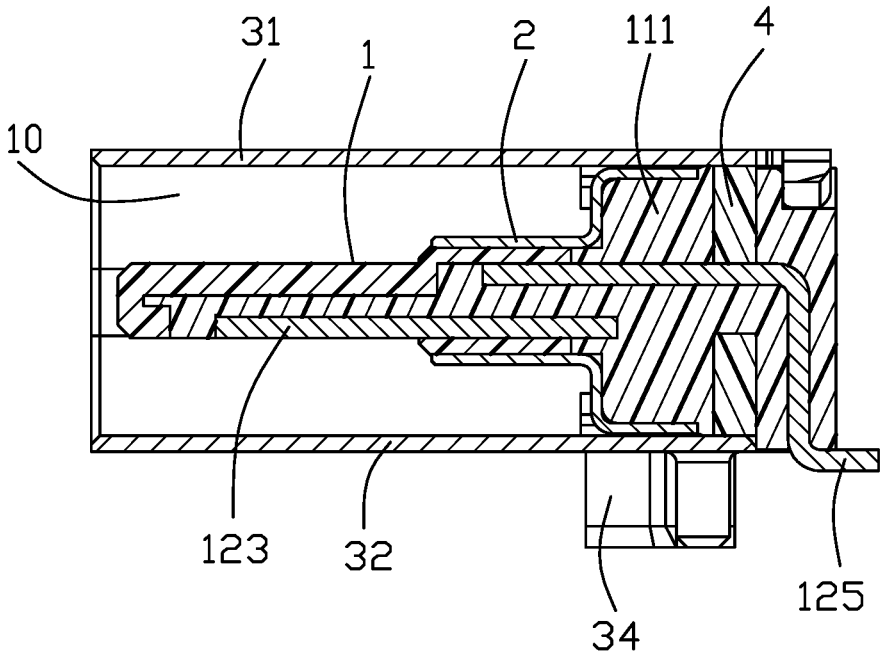
FIG. 10 is a cross-sectional view of the electrical connector taken along line 10-10 in FIG. 1.

Referring to FIGS. 5 to 6, the conductive terminals 12 include a number of upper terminals 121 and lower terminals 122 both affixed to the insulative housing 1. Each conductive terminal 12 includes a contacting portion 123 exposed to the tongue portion 112, a fixing portion 124 affixed to the base portion 111 and a soldering portion 125 extending rearward from the fixing portion 124.

Referring to FIGS. 5 to 6, the shielding plate 13 includes an arm 131 sandwiched between the upper terminals 121 and the lower terminals 122, a locating hole 133 located at a front end of the arm 131 and communicating a top surface and a bottom surface of the arm 131, and a hook 132 extending rearward from the arm 131. The arm 131 includes a locking side 1311 protruding laterally from the fixing groove 1113.

Referring to FIGS. 3 to 4 and FIGS. 7 to 10, the ground plates 2 are exposed to the tongue portion 112. Each ground plate 2 includes a front covering portion 21 exposed to the tongue portion 112, a rear covering portion 22 affixed to the fixing slot 1115, a pair of connecting portions 23 connecting the front covering portion 21 and the rear covering portion 22, and a pair of lateral fixed portions 24 bending downwardly from the front covering portion 21 and embedded in the tongue portion 24. The corresponding electrical connector contacts the ground plates 2 to realize grounding when the electrical connector mated.

Referring to FIGS. 1 to 4 and FIGS. 7 to 10, the shielding shell 3 made by metal injection molding or die casting, includes a first/top wall 31, a second/bottom wall 32 opposite to the first wall 31 in the vertical direction, and a pair of opposite lateral walls 33, along the transverse direction, connecting the first wall 31 and the second wall 32. The shielding shell 3 includes a pair of fixing legs 34 bending downwardly from a rear end of the lateral walls 33. A pair of locating posts (not labeled) downwardly extend from the second wall 32 between the pair of fixing legs 34. The first wall 31 includes a pair of tubers 311 formed on an interior surface thereof to resist against the resisting recesses 1111. The tubers 311 resist against the rear covering portion 22 extending to the fixing slot 1115 preventing the ground plates 2 moving forwardly. The first wall 31 includes a pair of resisting protrusions 312 extending obliquely and resisting against the fixing groove 1113 and the resisting tubers 1114. The thickness of the first wall 31 is smaller than that of the lateral walls 33. In the preferred embodiment, the thickness of the first wall 31 and the second wall is 0.15 mm. The thickness of the lateral wall 33 is a certain thickness between 0.2 mm and 0.3 mm. Since the thickness of the first wall 31 or the second wall 32 becomes thinner, the height of the electrical connector 100 is reduced, and the miniaturization of the electrical connector is achieved. In addition, because the thickness of the sidewall 33 is greater than the thickness of the first wall 31 or the second wall 32, the total strength of the whole structure is compensated for the weakened structure due to the thinned first wall 31 or the second wall 32.

In this embodiment, on one hand the immovable tuber 311 extends into the corresponding resisting recess 1111 while still keeping a flat exterior surface of the first wall 31, thus assuring waterproofing thereabouts, compared with the stamping type shielding shell requiring to split the tuber 311 therefrom that jeopardizing the waterproof function thereof. On the other hand, because the first wall 31 and the second wall 32 are intentionally thinned to own flexibility thereof, compared with the side walls 33, the deflectable resisting protrusion 312 on the first wall 31, which is originally located in a horizontal/original position (not shown) to allow the contact module 1 to be forwardly assembled into the receiving room 10, is deflected to extend into the fixing groove 1113 at the second/final position after the contact module 1 has been forwardly assembled into the receiving room 10 formed by the shielding shell 3 to prevent the backward movement of the contact module 1. Differently, the traditional or typical shielding shell made by metal injection molding lacks capability of deflection so as to be soldered or welded to the corresponding metal piece of the contact module for preventing backward movement of the contact module after the contact module is forwardly inserted into the receiving room from the rear side of the shielding shell. Such an additional soldering/welding increases the manufacturing cost, compared with the traditional shielding shell made by stamping sheet metal which has superior flexibility and inferior rigidity thereof. In brief, the instant invention essentially uses the hybrid method, i.e., metal injection molding and stamping, to have the relatively better both rigidity on the side walls and flexibility on the resisting protrusion thereof for not only enduring the possible significant forces during mating with the complementary plug connector but also easily retaining the contact module in position with regard to the metallic shielding shell after assembling the contact module into the metallic shielding shell, advantageously.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

a plurality of conductive terminals affixed to the insulative housing and each having a contacting portion disposed in the tongue portion; and a metallic shielding shell enclosing the insulative housing for forming a receiving room and having a first wall, a second wall opposite to the first wall, and a pair of lateral walls connecting the first wall and the second wall; wherein a thickness of the first wall is smaller than that of the lateral walls; and the base portion comprises a pair of resisting recesses located at a front end and a fixing slot communicating with the resisting recesses and extending laterally, the inner wall of the shielding shell comprises a pair of tubers resisting against the resisting recesses, the tongue portion comprises a stepped portion abutting with the base portion and a flat portion extending forwardly from the stepped portion, and the electrical connector further comprises a ground plate having a front covering portion exposed to the stepped portion and a rear covering portion attached to the fixing slot; and the insulative housing comprises a mounting portion located at a rear end of the base portion and having a fixing groove with an opening upwardly and a pair of resisting tubers located laterally besides the fixing groove in symmetry, the first wall comprises a pair of resisting protrusions extending obliquely in the receiving room, the resisting protrusions resist against the fixing groove and the resisting tubers, and the tubers resist against a front end of the rear covering portion extending to the fixing slot.

2. The electrical connector as claimed in claim 1, wherein a thickness of the second wall is smaller than that of the lateral walls.

3. The electrical connector as claimed in claim 1, wherein the shielding shell is made by metal integrated molding or metal injection molding, and the shielding shell comprises an inner wall and an outer wall both shaped as an arc-transition-structure.

4. The electrical connector as claimed in claim 3, wherein the shielding shell further comprises a pair of fixing legs extending downwardly from the lateral walls.

5. The electrical connector as claimed in claim 3, wherein the thickness of the first wall and the second wall is 0.15 mm, and the thickness of the lateral walls is between 0.2 mm and 0.3 mm.

6. The electrical connector as claimed in claim 1, wherein the ground plate is arranged in two affixed to the stepped portion, and each ground plate comprises a respective front covering portion, a respective rear covering portion and a connecting portion connecting the front covering portion and the rear covering portion.

7. The electrical connector as claimed in claim 6, wherein the ground plate is integrated with the insulative housing, and the ground plate comprises a pair of lateral fixed portions bending downwardly from the stepped portion and embedded in the tongue portion.

8. The electrical connector as claimed in claim 1, wherein the shielding shell comprises a pair of barriers recessed in the lateral walls, the conductive terminals comprises a plurality of upper terminals and lower terminals, and the electrical connector comprises a shielding plate sandwiched between the upper terminals and the lower terminals and having a pair of hooks extending rearward and resisting against the barriers.

9. An electrical connector comprising:

a tubular metallic shielding shell made by metal injection molding and forming therein a receiving room extending along a front-to-back direction by opposite top and bottom walls in a vertical direction perpendicular to the front-to-back direction, and two opposite lateral side walls, a thickness of the top wall being smaller than that of the side wall;

a stationary tuber directly formed on an interior surface of the shielding shell by metal injection molding and extending into the receiving room, and a deflectable resisting protrusion directly formed on a rear end of the shielding shell by metal injection molding and located behind the tuber in the front-to-back direction; and a contact module including a plurality of conductive contacts fixed within an insulative housing, said housing including a base portion and a tongue portion extending forwardly from the base portion along the front-to-back direction, wherein said resisting protrusion is originally located at a first position to allow the contact module to be forwardly assembled into the receiving room from a rear side of the shielding shell until being confronted by the stationary tuber, and the resisting protrusion is successively deflected to a second position to prevent backward movement of the contact module with regard to the shielding shell so as to have the base portion of the housing sandwiched between the tuber and the resisting protrusion in the front-to-back direction for retaining the contact module within the shielding shell.

10. The electrical connector as claimed in claim 9, wherein said tuber is located in a resisting groove formed in the base portion.

11. The electrical connector as claimed in claim 9, wherein said resisting protrusion is located in the fixing groove formed in the base portion.

12. The electrical connector as claimed in claim 9, wherein both said tuber and said resisting protrusion are commonly formed on the top wall.

13. The electrical connector as claimed in claim 9, wherein the shielding shell keeps a flat exterior surface opposite to said tuber in the vertical direction.

14. A method of making a low profile electrical connector, comprising steps of:

providing a tuber metallic shielding shell by metal injection molding with opposite top and bottom walls in a vertical direction and a pair of opposite lateral side walls along a transverse direction perpendicular to said vertical direction to commonly form therein a receiving room extending along a front-to-back direction perpendicular to both said vertical direction and said transverse direction wherein a thickness of either the top wall or the bottom wall is smaller than those of the side walls, wherein said shielding shell unitarily forms an immoveable tuber extending into the receiving room, and a deflectable resisting protrusion located behind the tuber in the front-to-back direction;

forming a contact module via insert molding with a plurality of conductive contacts fixed within an insulative housing, said housing including a base portion and a tongue portion forwardly extending from the base portion in the front-to-back direction; and forwardly assembling said contact module into the receiving room from a rear side of the shielding shell in said front-to-back direction until the base portion forwardly abuts against the tuber when the resisting protrusion is located at a first position, and successively deflecting the resisting protrusion toward a second position to prevent backward movement of the contact module with regard to the shielding shell in the front-to-back direction so as to have the base portion snugly sandwiched between the tuber and the resisting protrusion in the front-to-back direction.

15. The method as claimed in claim 14, wherein said tuber is located in a resisting groove formed in the base portion.

16. The method as claimed in claim 14, wherein said resisting protrusion is located in the fixing groove formed in the base portion.

17. The electrical connector as claimed in claim 14, wherein both said tuber and said resisting protrusion are commonly formed on the top wall.

18. The electrical connector as claimed in claim 14, wherein the shielding shell keeps a flat exterior surface opposite to said tuber in the vertical direction.

* * * * *